US005712447A

United States Patent [19]

Hanson

[11] Patent Number: 5,712,447

[45] Date of Patent: Jan. 27, 1998

[54] VIBRATIONALLY AND ACOUSTICALLY INSULATED STRUCTURE

[75] Inventor: Jeffrey S. Hanson, Wakefield, R.I.

[73] Assignee: The United States of America as represented by the Secretary of the Navy, Washington, D.C.

[21] Appl. No.: 645,735

[22] Filed: May 14, 1996

[51] Int. Cl.[6] ..... F42B 19/00; G10K 11/16; E04B 1/82

[52] U.S. Cl. ..... 114/20.1; 114/20.2; 114/312; 181/208; 181/284; 181/290; 181/292; 181/294; 367/149; 367/151; 367/173; 367/176

[58] Field of Search ..... 114/20.1, 20.2, 114/312, 342; 156/71; 181/208, 284, 286, 290, 292, 294; 367/1, 149, 176, 173, 151

[56] References Cited

U.S. PATENT DOCUMENTS

| | | | |
|---|---|---|---|
| 3,130,700 | 4/1964 | Peterson | 114/20.1 |
| 4,399,526 | 8/1983 | Eynck | 367/149 |
| 4,756,264 | 7/1988 | Ewbank | 114/20.1 |
| 5,094,318 | 3/1992 | Maeda et al. | 181/290 |
| 5,106,439 | 4/1992 | Wellings et al. | 156/71 |
| 5,153,388 | 10/1992 | Wittenmayer et al. | 181/290 |
| 5,186,996 | 2/1993 | Alts | 181/290 X |
| 5,245,141 | 9/1993 | Fortez et al. | 181/290 X |
| 5,389,746 | 2/1995 | Moody | 181/0.5 |
| 5,396,855 | 3/1995 | DuBois | 114/20.1 |
| 5,483,028 | 1/1996 | Holwerda | 181/290 X |

*Primary Examiner*—Michael J. Carone
*Assistant Examiner*—Matthew J. Lattig
*Attorney, Agent, or Firm*—Michael J. McGowan; James M. Kasischke; Prithvi C. Lall

[57] ABSTRACT

A vibrationally and acoustically insulated structure includes a structure housing enclosing a source of internally generated noise and vibrations. The structure further includes a vibration and acoustic insulating device positioned over a portion of the internal surface of the housing and having a vibration damping portion and acoustic absorbing portion. The vibration damping portion, such as a constrained damping layer having a continuous damping layer and a segmented constraining layer of individual rigid segments, reduces vibrations transmitted through the structure housing. The acoustic absorbing portion includes an acoustic barrier layer adjacent the constrained damping layer, an acoustic absorption layer adjacent to the acoustic barrier layer and one or more mounts for mounting the acoustic absorption layer and acoustic barrier layer to the constrained damping layer. The acoustic absorption device reduces the reverberating acoustic waves within the structure housing. The mounts typically include an elongated threaded post, such as a snap nut, extending from one of the individual rigid segments and a threaded fastener threadably engaged with the elongated threaded post to secure the acoustic absorption layer.

16 Claims, 3 Drawing Sheets

VIBRATIONALLY AND ACOUSTICALLY INSULATED STRUCTURE

STATEMENT OF GOVERNMENT INTEREST

The invention described herein may be manufactured and used by or for the Government of the United States of America for governmental purposes without the payment of any royalties thereon or therefor.

CROSS-REFERENCE TO RELATED PATENT APPLICATIONS

This patent application is with three related patent applications entitled ISOLATION MOUNTING DEVICE (U.S. patent application Ser. No. 08/645,732), ACOUSTIC ABSORBING DEVICE (U.S. patent application Ser. No. 08/645,736) and VIBRATIONALLY DAMPED STRUCTURE (U.S. application Ser. No. 08/645,734) by the same inventor as this application.

BACKGROUND OF THE INVENTION (1) Field Of The Invention

This invention relates to a vibrationally and acoustically insulated structure and in particular, to a vibration and acoustic insulating device for use on a structure such as an underwater vehicle hull.

(2) Description Of The Prior Art

In structures having internal mechanisms, such as vehicles and particularly underwater vehicles, the internal mechanisms generate acoustic waves or noise within the structure and cause vibrations that are transmitted to the structure. In particular, underwater vehicles such as torpedoes include propulsion systems (e.g., motors or engines), internal components (e.g., initial guidance systems and tape records), and propulsors that generate both directly radiated hydrodynamic and re-radiated structural excitation. Also in underwater vehicles, turbulent boundary layer flow noise is generated and transmitted through the hull structure.

The transmission of vibrational energy through the hull structure and the reverberation of internal noise within the hull structure is a particular concern in underwater vehicles and similar structures. Noise generated by the internal systems or mechanisms reverberates within the enclosed hull of the underwater vehicle and the hull acts as a radiator for the reverberating noise. The noise reverberating within the hull is enhanced further by vibrations transmitted through the hull structure from the internal components or mechanisms and from the turbulent boundary layer.

Noise reduction can be achieved by isolating components from the hull or by lowering the source levels of the vibrational energy generated by components, such as the motor, through balancing. However, an inexpensive way of further minimizing hull vibration and reducing internal noise is by damping the hull and providing an acoustic absorbing device. The prior art has not provided a device that effectively dampens vibrations in the hull structure and reduces noise within the structure.

U.S. Pat. No. 3,130,700 to Peterson discloses a vibration and mechanical wave attenuating layer covering the exterior surface of a submarine hull. The damping layer actually includes three layers: a central sheet 13 having a dense material 16, and two sandwiching sheets 14, 15. Such a structure requiring dense material such as a plurality of small pellets or other small metal particles may be expensive and could unnecessarily increase the weight of the underwater vehicle. Moreover, the damping layer of Peterson is mounted on the exterior surface of the submarine and does not reduce reverberating noise within the enclosed vehicle.

U.S. Pat. No. 5,396,855 to DuBois discloses a tail cone assembly for a torpedo including a elastomeric material bonded to inner and outer surfaces of a tubular sheet of a tail cone. This structure, however, will provide only minimal damping in the tail cone. The structure cannot be easily installed throughout the entire underwater vehicle, nor does the structure effectively absorb reverberating noise within the vehicle.

Accordingly, what is needed is a vibration and acoustic insulating device that can easily be installed throughout the interior surface of an enclosed vehicle, such as a torpedo or other similar underwater vehicle.

SUMMARY OF THE INVENTION

One object of the vibration and acoustic insulating device is to dampen vibrations transmitted throughout the structure with a vibration damping portion while an acoustic absorbing portion reduces the reverberating noise within the structure.

A further object is to provide a device that is easily and inexpensively installed throughout any surface within the enclosed structure.

The present invention provides a vibrationally and acoustically insulated structure, such as underwater vehicle hull. The structure generally includes a structure housing enclosing at least a source of internally generated noise and vibrations and includes a vibration and acoustic insulating device positioned over at least a portion of said structure housing. In the preferred embodiment, the vibration and acoustic insulating device is positioned over a portion of an interior surface of an underwater vehicle hull.

The vibration and acoustic insulating device generally includes a vibration damping portion fixed to the structure housing for damping vibrations transmitted through the structure housing, and an acoustic absorbing portion fixed proximate the vibration damping portion for reducing reverberating acoustic waves within the structure.

The preferred embodiment of the vibration damping portion is a constrained damping layer generally including at least one continuous damping layer fixed to a surface of the structure and at least one segmented constraining layer fixed to and positioned over at least a portion of the continuous damping layer. The continuous damping layer provides a first reduction of vibrational energy transmitted through the structure housing. The segmented constraining layer provides a second reduction of vibrational energy transmitted through the structure housing and the continuous damping layer.

The continuous damping layer is preferably made of an elastomeric material that is bonded to the surface of the structure housing with a first bonding compound layer, such as an epoxy. The preferred segmented constraining layer includes a plurality of rigid segments, such as aluminum segments, fixed to the continuous damping layer with a predetermined spacing between each segment. A second bonding compound layer, such as an epoxy, bonds the rigid segment to the continuous damping layer.

In the preferred embodiment, the acoustic absorbing portion includes an acoustic barrier layer having a predetermined thickness and covering at least a portion of the segmented constraining layer. The preferred acoustic absorbing device further includes an acoustic absorption layer generally fixed adjacent the acoustic barrier layer for reducing noise generated within the structure.

In the preferred embodiment, at least one isolation mount mounts the acoustic absorption layer to the vibration damping portion. An isolation mount generally includes a fastener engaging portion extending from the segmented layer of the vibration damping portion and a fastener cooperating with the acoustic absorption layer and engaged with the fastener engaging portion. Preferably, the fastener engaging portion includes an internally threaded post extending through a segment of the segmented layer, through the barrier layer, and through the acoustic absorption layer and threadably engaging an elongated threaded member. The isolation mount thereby mounts the acoustic absorption layer and barrier layer to the vibration damping portion while isolating the mount and layers from vibrations transmitted through the structure.

The predetermined thickness of the acoustic barrier layer generally corresponds with the distance from the structure in which there exists a predefined frequency region. In one embodiment, the acoustic barrier layer is a barrier of air. In another embodiment, the acoustic barrier layer includes an acoustic barrier material that breaks up transmitted and reflected pressure waves and also displaces internal fluid build up within the structure. Preferably, the acoustic absorption material is capable of dispersing incident normal pressure waves within the structure.

BRIEF DESCRIPTION OF THE DRAWINGS

These and other features and advantages of the present invention will be better understood in view of the following description of the invention taken together with the drawings wherein.

DESCRIPTION OF THE PREFERRED EMBODIMENT

Figure 1:
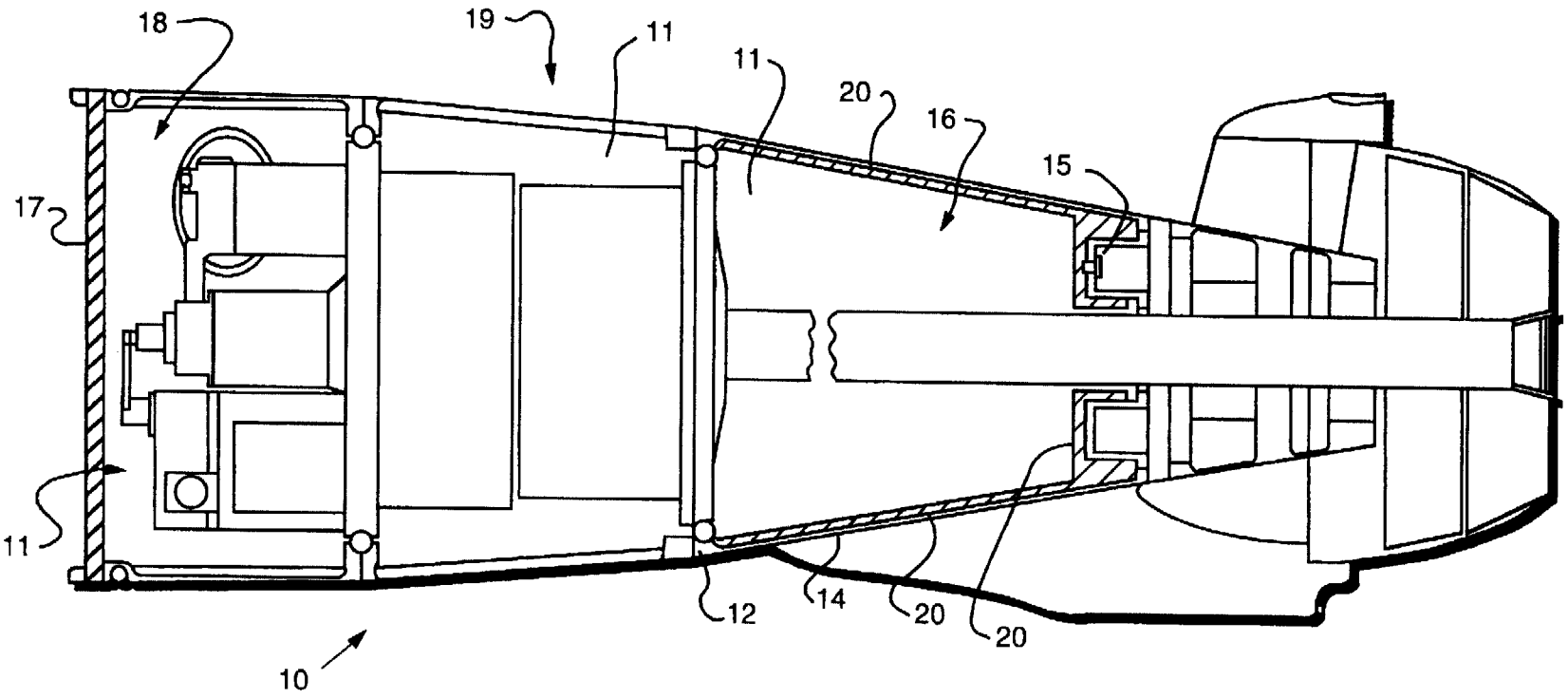
FIG. 1 is a side-sectional view of an underwater vehicle having a vibration and acoustic insulating device according to the present invention.

The vibrationally and acoustically insulated structure 10, FIG. 1, according to the present invention generally includes a structure housing 12 and a vibration and acoustic insulating device 20 fixed to at least a portion of the structure housing 12. In the vibrationally and acoustically insulated structure 10, the structure housing 12 encloses internal mechanisms 11 such as motors, gears, propulsion units that generate noise and vibrations. For example, the present invention contemplates using the vibration and acoustic insulating device 20 on the interior of a vehicle and particularly an underwater vehicle such as a torpedo.

The vibration and acoustic absorbing device 20 is mounted proximate at least a portion of an interior surface 14 of the structure housing 12. The vibration and acoustic insulating device 20 can be mounted throughout the entire interior surface 14 of the structure of vehicle 10 or mounted over selected portions in areas which are particularly susceptible to vibrations or reverberating acoustic waves. For example, in a torpedo or other similar underwater vehicle, the vibration and acoustic insulating device 20 is preferably mounted around the interior surface 14 and on the bulkhead 15 and endplate 17.

Figure 2:
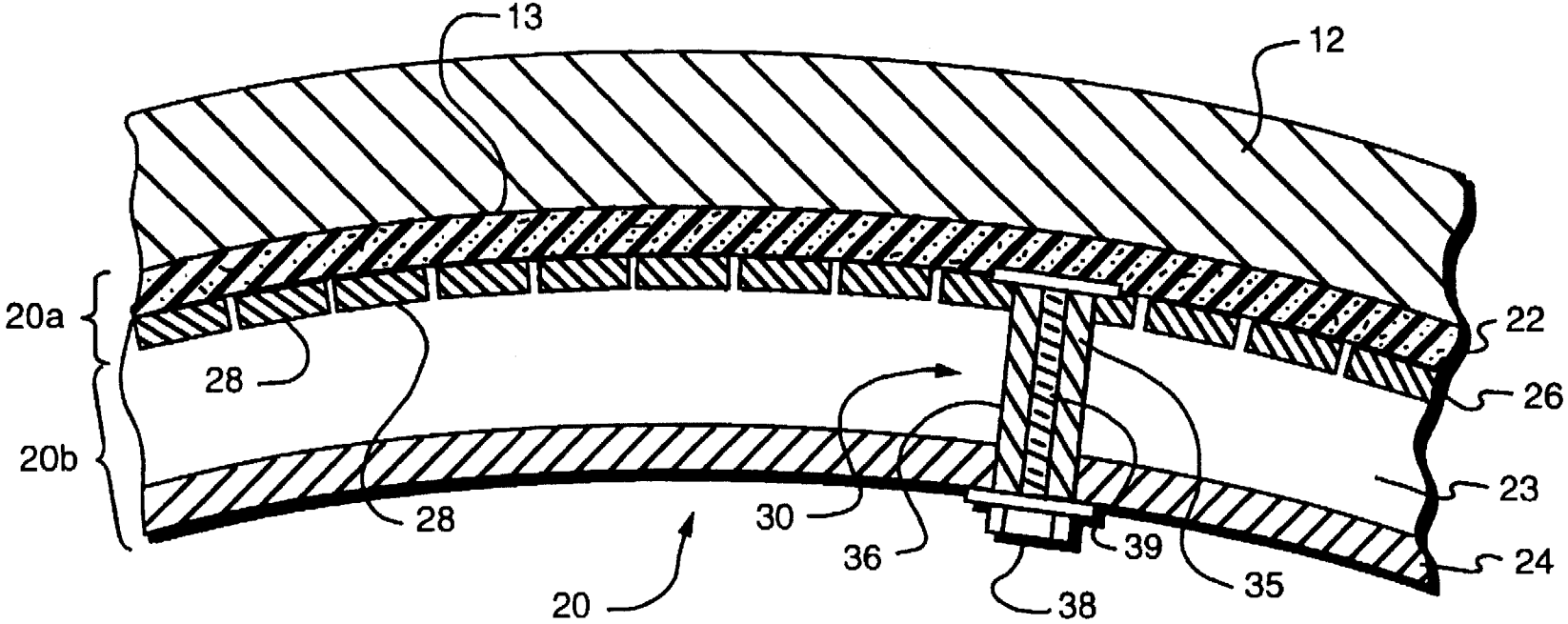
FIG. 2 is a cross-sectional view of the vibration and acoustic insulating device according to one embodiment of the present invention mounted to a vehicle hull.

The vibration and acoustic insulating device 20, FIG. 2, according to the present invention generally includes a vibration damping portion **20*a* such as a constrained damping layer for damping vibrations transmitted through the structure housing 12, and an acoustic absorbing portion 20*b*, for reducing reverberating acoustic waves within the structure. The vibration damping portion 20*a* is fixed to at least a portion of a structure housing surface 13 by bonding. The acoustic absorbing portion 20*b* is fixed against the vibration damping portion 20*a*, by one or more mounts 30**.

In the vibration damping portion **20*a* a continuous damping layer 22 is fixed to and positioned substantially in contact with at least a portion of the surface 13. A segmented constraining layer 26 is fixed to and positioned over at least a portion of the continuous damping layer 22**.

The vibration damping portion **20*a* provides damping by dissipating vibrational energy waves traveling through the structure housing 12. In the absence of any damping portion 20*a*, a vibrational energy wave will travel through the structure housing 12 freely, and the structure housing 12 acts as an acoustic radiator. When a layer of damping material 22 is added to the structure housing surface 13, the continuous damping layer 22 causes the vibrational energy wave to be sheared as it travels through the structure housing 12. Since the sheared waves travel through the continuous damping layer 22 and structure 12 at different speeds, the sheared vibrational energy waves destructively interact and dissipate the vibrational energy. The vibrational energy is further dissipated by adding the individual segments 28 of the constraining layer 26 that further shear the vibrational energy wave. The individual segments 28 break up the waves as they propagate between each segment 28. The segments 28 also act to reduce the movement of the damping material 22**.

The continuous damping layer 22 is preferably made of an elastomeric damping material, such as C-1002-12 from EAR Division of the Cabot Corp. However, the present invention contemplates any elastomeric material suitable to withstand high temperature environments and to sufficiently reduce vibrations. This material should have a damping ratio near one over a broad frequency range. The thickness of the continuous damping layer 22 should be sufficient to reduce structural vibrations in the vibrating structure 12. In one example, a layer of approximately 0.125 inches thick of elastomeric material is sufficient.

The segmented constraining layer 26 generally includes a plurality of rigid segments 28 fixed to the continuous damping layer 22 with a predetermined spacing between each of the rigid segments 28. Each rigid segment 28 preferably has a size in the range of 20 to 30 square inches and a predetermined spacing sufficient to dampen vibrations without each segment 28 contacting an adjacent segment. In one example, segments 28 have a thickness of approximately 0.063 inches and a predetermined spacing of approximately 1/16 inches apart. The rigid segments 28 are preferably made of a rigid material such as aluminum sufficient to enhance the damping properties of continuous damping layer 22. Although the rigid segments 28 are typically blocks having a rectangular or square shape, the present invention contemplates various shapes of the segments 28.

The continuous damping layer 22 is preferably bonded to structure housing surface 13 with a bonding compound, such as two part Loctite Depends 325 epoxy. The rigid segments 28 of the segmented constraining layer 26 are also preferably bonded to the continuous damping layer 22 with a bonding compound, such as the two part Loctite Depends 325 epoxy. Other similar bonding compounds or epoxies such as acrylic adhesives can be used provided that they effectuate a homogenous bond between the layers and can withstand high temperature environments. Further, a bonding compound or epoxy that is least toxic is preferred.

The bonding of the layers with a two part epoxy is accomplished by first sandblasting the surface 13 of structure housing surface 13 and then applying the epoxy liquid part to the surface 13, e.g., with a trowel, so as to minimize the thickness of the layer of the epoxy liquid. The second epoxy part, the aerosol spray, is then lightly applied to the continuous damping layer 22. After the two part bonding compound has been applied to the structure surface 13 and the continuous damping layer 22, the user has up to one hour before placing the damping layer 22 onto the structure surface 13. However, once the damping material 22 is placed onto the structure surface 13, the two part epoxy bonding compound typically allows bonding to be completed quickly, for example, in less than one minute. The rigid segments 28 are bonded to the damping material 22 in the same manner described above.

The acoustic absorbing portion **20*b* generally includes an acoustic barrier layer 23 and an acoustic absorption layer 24. The acoustic absorption layer 24 and acoustic barrier layer 23 are preferably mounted to the structure housing 12 with one or more mounts 30 fixed to the constrained damping layer 20*a* (or vibration damping portion). Typically, the plurality of mounts 30 are spaced throughout the length of the structure housing 12 so that the acoustic absorbing portion is structurally supported against the vibration damping portion 20*a*. Mounts 30** can be any mounting method well known in the art.

The acoustic absorption layer 24 is made of an acoustic absorption material that is capable of dispersing incident normal pressure waves within the structure housing 12, thereby absorbing and reducing the reverberant field pressure levels (e.g., noise) within the structure 12. In one example, the acoustic absorption layer 24 is made from a 0.063 inch thick, sintered aluminum, sound absorbing plate having substantially random perforations therethrough. This can be a commercially available material such as ALMUTE® manufactured by NDC Co., Ltd. or the like. The present invention, however, contemplates other absorption materials and other thicknesses provided that the absorption material is capable of dispersing incident normal pressure waves and absorbing and reducing the reverberant acoustic waves within the hull structure. The preferred acoustic absorption material in an underwater vehicle such as a torpedo should also be capable of withstanding water and high temperatures.

In the embodiment shown in FIG. 2, the acoustic barrier layer includes an acoustic barrier material layer 23 held between the absorption material layer 24 and the constraining layer 26 of the vibration damping portion **20*a*. Preferably, the predetermined thickness of the acoustic barrier layer 23 is determined based upon a frequency region defined by the distance from the hull structure 12 in which the most acoustic absorption is needed because of a concentration of reverberating acoustic waves. The acoustic barrier material layer 23 further "breaks up" any transmitted and reflected acoustic pressure waves in this frequency region as they travel within the acoustic barrier material 23, thereby further minimizing the communication of internally generated airborne noise to the hull structure 12**.

An acoustic barrier material layer 23 is preferred for use on a hull structure 12 that is susceptible to fluids, such as an underwater vehicle that permits internal fluid build up. In this embodiment, the acoustic barrier material 23 should be a fluid resistant material that will displace the residual internal fluids from the acoustic barrier layer 23. Further, the preferred acoustic barrier material for use in an underwater vehicle such as a torpedo should be able to withstand high pressures, heat, exhaust, steam or other conditions typical to an underwater vehicle internal environment. Some examples of an acoustic barrier material include a fluid resistant acoustic barrier material or a lightweight aluminum foil honeycomb material that breaks up the transmitted and reflected waves as they travel through each cell of the honeycomb material. The present invention, however, also contemplates other similar acoustic barrier materials having the desired characteristics.

Figure 3:
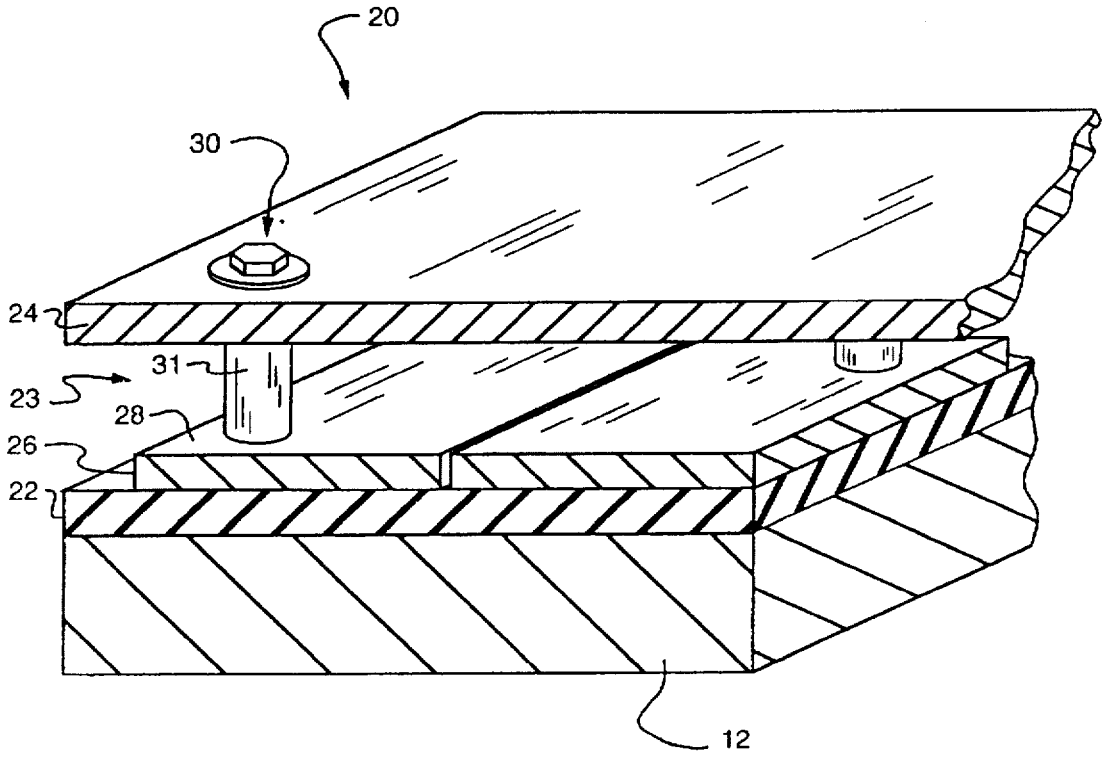
FIG. 3 is a perspective cross-sectional illustration of section of the structure having the vibration and acoustic insulating device according to another embodiment of the present invention.

In another embodiment, FIG. 3, the acoustic barrier layer 23 includes an air space. The acoustic barrier layer 23 of free air space can be used in an enclosed structure that is not susceptible to internal fluids, such as an underwater vehicle that does not permit fluid build up. As pressure or acoustic waves pass through the free air space in acoustic barrier layer 23, the air space acts as an acoustic barrier 23 to reduce the intensity of the waves. In this embodiment, a standoff portion 31 is used with the mount 30 to mount the acoustic absorption material layer 24 at a distance from the hull structure 12 corresponding to the predetermined thickness of the air space acoustic barrier layer 23.

In the preferred embodiment, the mount 30 can be an isolation mount that mounts the acoustic absorption material layer 24 to the structure 12 while isolating the mount 30 and the layer 24 from vibrations transmitted through the structure housing 12. One type of isolation mount is the isolation mount disclosed in co-pending application Ser. No. 08/645,732 entitled ISOLATION MOUNTING DEVICE, incorporated herein by reference.

The isolation mount 30 includes a fastener engaging portion 36 secured to and extending from one of the rigid segments 28 and a fastener 38 cooperating with the acoustic absorption layer 24 and engaged with the fastener engaging portion 36. Preferably, the fastener engaging portion 36 includes an internally threaded post 35 extending from the rigid segments 28 and through the barrier layer 23 and acoustic absorption layer 24. The internally threaded post 35 threadably receives a threaded fastener 39 such as a bolt, thereby mounting the acoustic absorption layer 24 and barrier layer 23. In one example, a snap nut can be mounted through a hole punched in a rigid segment 28 and crimped to the rigid segment 28 with a snap nut crimping tool prior to bonding the rigid segment 28 to the damping material 22. If the barrier layer 23 is air space, a standoff sleeve 31 is positioned around the post 35 to secure the acoustic absorption layer at the predetermined distance from the segmented constraining layer 26.

Accordingly, the vibration and acoustic insulating device according to the present invention can be relatively easily and inexpensively mounted throughout an interior surface of a structure such as an underwater vehicle to reduce internal noise within the structure and vibrations transmitted through the structure housing. The vibration damping portion or constrained damping layer effectively dissipates vibrational energy waves as they travel through the structure housing 12. The acoustic absorbing portion effectively disperses incident normal pressure waves within the structure to reduce the reverberating noise within the structure.

In light of the above, it is therefore understood that within the scope of the appended claims, the invention may be practiced otherwise than as specifically described.

What is claimed is:

1. A vibrationally and acoustically insulated device disposed within a structure housing comprising:

a vibration damping portion fixed to and substantially contiguous with at least a portion of a surface of said structure housing for damping vibrations transmitted through said structure housing; and an acoustic absorbing portion fixed proximate said vibration damping portion for reducing reverberating acoustic waves within said structure;

said vibration damping portion comprising:

a constrained damping layer having at least one continuous damping layer fixed to said at least a portion of a surface of said structure housing; and a segmented constraining layer fixed to at least a portion of said at least one continuous damping layer.

2. The device of claim 1, wherein said constrained damping layer includes a layer of elastomeric damping material.

3. The device of claim 1, wherein said segmented constraining layer includes a plurality of rigid segments fixed to said at least a portion of said constrained damping layer, said rigid segments being spaced apart from one another by a predetermined distance.

4. The device of claim 1, further comprising:

a first bonding compound layer bonding said constrained damping layer to said at least a portion of a surface of said structure housing; and a second bonding compound layer bonding said segmented constraining layer to said at least a portion of said constrained damping layer.

5. A vibrationally and acoustically insulated device disposed within a structure housing comprising:

a vibration damping portion fixed to and substantially contiguous with at least a portion of a surface of said structure housing for damping vibrations transmitted through said structure housing; and an acoustic absorbing portion fixed proximate said vibration damping portion for reducing reverberating acoustic waves within said structure;

said acoustic absorbing portion comprising:

at least one mount joined to said vibration damping portion;

an acoustic absorption layer mounted to said vibration damping portion with said at least one mount; and a barrier layer positioned between said acoustic absorption layer and said vibration damping portion and having a predetermined thickness.

6. The device of claim 5, wherein said barrier layer is a layer of air.

7. The device of claim 5, wherein said acoustic barrier layer is made from an acoustic barrier material, which breaks up transmitted and reflected pressure waves in a predefined frequency range.

8. The device of claim 7, wherein said acoustic barrier layer is made from at least one of a fluid resistant material and a heat resistant material.

9. The device of claim 5, wherein said acoustic absorption layer is made from a material capable of dispersing incident normal pressure waves within said structure housing.

10. The device of claim 5, wherein said at least one mount includes:

a fastener engaging portion extending generally from said vibration damping portion; and a fastener engaged with said fastener engaging portion, and mounting said acoustic absorption layer to said vibration damping portion.

11. The device of claim 10, wherein said fastener engaging portion includes an internally threaded post extending through said acoustic barrier layer and said acoustic absorption layer, and said fastener includes a threaded fastener threadably received in said internally threaded post.

12. The device of claim 11, wherein said acoustic barrier layer includes a layer of air space, and said at least one mount includes a standoff sleeve positioned around said internally threaded post, said acoustic absorption layer being mounted between said threaded fastener and said standoff sleeve at a distance from said vibration damping portion that corresponds to said predetermined thickness of said acoustic barrier layer.

13. The device of claim 11, wherein:

said acoustic barrier layer is made from an acoustic barrier material which breaks up transmitted and reflected pressure waves;

said internally threaded post extends through said acoustic barrier material and said acoustic absorption layer; and said threaded fastener secures said acoustic absorption layer and said acoustic barrier material to said vibration damping portion.

14. A vibration and acoustic insulating device, for vibrationally and acoustically insulating a structure housing from a source of generated noise and vibrations, said vibration and acoustic insulating device comprising:

a continuous damping layer positioned over and fixed to at least a portion of a surface of the structure for providing a first reduction in vibrational energy transmitted through the structure housing;

a segmented constraining layer having a plurality of individual rigid segments fixed to said continuous damping layer with a predetermined distance between each of said plurality of individual rigid segments, for providing a second reduction of vibrational energy transmitted through the structure housing and said continuous damping layer;

at least one mount, for mounting to said segmented constraining layer, said at least one mount including a fastener engaging portion fixed to and extending from said segmented constraining layer and a fastener joined to said fastener engaging portion;

an acoustic absorption layer mounted to said segmented constraining layer with said at least one mount for reducing noise generated within the structure; and an acoustic barrier layer disposed between said segmented constraining layer and said acoustic absorption layer and having a predetermined thickness corresponding to a predefined noise frequency region.

15. The vibration and acoustic insulating device of claim 14, wherein said acoustic barrier layer includes a layer of air space, and said at least one mount includes a standoff portion, for mounting said acoustic absorption layer at a predetermined distance from said segmented constraining layer.

16. A vibrationally and acoustically insulated device disposed within a structure housing comprising:

a continuous damping layer fixed to and substantially in contact with said at least a portion of a surface of said structure housing;

a segmented constraining layer fixed to at least a portion of said at least one continuous damping layer, wherein said continuous damping layer and said segmented constraining layer dampen vibrations transmitted through said structure housing;

an acoustic absorption layer mounted to said segmented constraining layer; and a barrier layer positioned between said acoustic absorption layer and said segmented constraining layer, said barrier layer cooperating with said acoustic absorption layer to reduce acoustic waves within said structure housing.

* * * * *